US008277641B2

(12) United States Patent
Tertel et al.

(10) Patent No.: US 8,277,641 B2
(45) **Date of Patent: *Oct. 2, 2012**

(54) SEPARATION VESSEL OR PART THEREOF, AND PROCESS RELATING THERETO

(75) Inventors: Jonathan A. Tertel, Mount Prospect, IL (US); July S. Maglente, Prairie Grove, IL (US); David A. Bahr, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/218,640

(22) Filed: Aug. 26, 2011

(65) Prior Publication Data

US 2011/0308387 A1 Dec. 22, 2011

Related U.S. Application Data

(62) Division of application No. 12/270,909, filed on Nov. 14, 2008, now Pat. No. 8,028,975.

(51) Int. Cl.
*C10G 21/10* (2006.01)

(52) U.S. Cl. ..... 208/226; 208/227; 208/228; 261/75; 261/76; 261/78.1; 261/115; 261/116; 261/117; 261/118; 210/188

(58) Field of Classification Search ..... 208/226–228, 208/230–231, 234–235; 261/75–76, 78.1, 261/115–118; 210/188, 322, 513, 519; 95/135, 95/137, 235; 585/854

See application file for complete search history.

(56) References Cited

U.S. PATENT DOCUMENTS 4,828,707 A * 5/1989 Staehle et al. ..... 210/649

* cited by examiner

*Primary Examiner* — Walter D Griffin
*Assistant Examiner* — Brian McCaig
(74) *Attorney, Agent, or Firm* — James C. Paschall

(57) ABSTRACT

One exemplary embodiment can be a stack for a separation vessel adapted to receive a fluid having one or more phases. The stack may include one or more walls surrounding a void, a packed bed positioned within the void, and a distributor positioned above the packed bed. Generally, the stack has a height greater than its width. Usually, the separation vessel further includes a base having a length greater than its height, and the height of the stack is orientated substantially perpendicular to the length of the base.

19 Claims, 2 Drawing Sheets

SEPARATION VESSEL OR PART THEREOF, AND PROCESS RELATING THERETO

CROSS-REFERENCE TO RELATED APPLICATION

This application is a Division of U.S. application Ser. No. 12/270,909, now U.S. Pat. No. 8,028,975, filed Nov. 14, 2008, the contents of which are hereby incorporated by reference in its entirety.

FIELD OF THE INVENTION

This invention generally relates to a separation vessel receiving a fluid.

DESCRIPTION OF THE RELATED ART

Often, hydrocarbon and gas streams are treated to remove sulfur-containing compounds, such as mercaptans. Generally, such compounds are removed because of their malodorous scent.

Mercaptans can be designated R—S—H where R is often a light hydrocarbon radical such as methyl or ethyl. Typically, mercaptans concentrate in hydrocarbon liquid streams separated in a process facility. Many processes can be used to remove mercaptans and other sulfur-containing compounds. Often, such processes can use a caustic stream contacting the hydrocarbon stream in an extractive system.

After use, the caustic stream may be regenerated. As such, air may be used for oxidizing mercaptans to disulfide oils. The unreacted components of the air stream, e.g. nitrogen, oxygen, and other inert gases, are separated from the caustic and disulfide oils. Often, a separation vessel allows the unreacted air components to exit in a vent gas stream. Generally, the vent gas stream contains primarily air and small amounts of water, hydrocarbons, and disulfide oils. Typically, this air stream can contain up to about one mole percent disulfide. However, the presence of disulfide oils can create regulatory concerns. Due to these concerns, it is often desired to treat the vent gas to remove the disulfide oils.

Often units are built under past regulatory codes and do not have equipment readily adapted to facilitate this removal. As a consequence, it would be desired to provide devices that could be incorporated into existing apparatuses to facilitate the removal of the disulfide oils in an economic and efficient manner.

SUMMARY OF THE INVENTION

One exemplary embodiment can be a stack for a separation vessel adapted to receive a fluid having one or more phases. The stack may include one or more walls surrounding a void, a packed bed positioned within the void, and a distributor positioned above the packed bed. Generally, the stack has a height greater than its width. Usually, the separation vessel further includes a base having a length greater than its height, and the height of the stack is orientated substantially perpendicular to the length of the base.

Another exemplary embodiment may be a separation vessel. The separation vessel can have a base defining an interior space at least for separating one liquid phase from another liquid phase. The base can include a coalescer positioned in the interior space. The separation vessel can further have a stack adapted to receive a fluid having one or more phases and coupled to the base. Moreover, the stack defines a void and further comprises one or more walls surrounding the void, a packed bed positioned within the void, and a distributor positioned above the packed bed.

A further exemplary embodiment can be a process for removing one or more sulfur-containing hydrocarbons from a gas. The process may include producing an effluent including a caustic, one or more hydrocarbons, one or more sulfur compounds, and a gas from an oxidation vessel; and sending the effluent to a stack of a disulfide separator. Typically, the stack includes one or more walls surrounding a void and adapted to receive a fluid including one or more phases, a packed bed positioned within the void, and a distributor including one or more risers and one or more compartments coupled to a substantially horizontal member forming a plurality of apertures there-through.

As disclosed herein, the embodiments can provide an efficient and effective modification to an existing vessel to allow the removal of sulfur-containing compounds from a waste gas stream. Alternatively, the features as disclosed herein can be included in a new vessel. As a consequence, the device disclosed herein can facilitate the removal of these compounds and allow an apparatus to meet regulatory requirements. Thus, these embodiments can minimize upgrade costs to an existing apparatus or vessel in an efficient and effective manner.

DEFINITIONS

As used herein, hydrocarbon molecules may be abbreviated C1, C2, C3 . . . Cn where "n" represents the number of carbon atoms in the one or more hydrocarbon molecules.

As used herein, the term "rich" can mean an amount of generally at least about 50%, and preferably about 70%, by mole, of a compound or class of compounds in a stream.

As used herein, the term "substantially" can mean an amount of generally at least about 80%, preferably about 90%, and optimally about 99%, by mole, of a compound or class of compounds in a stream.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, an adsorber, or a vessel, can further include one or more zones or sub-zones.

As used herein, the term "coupled" can mean two items, directly or indirectly, joined, fastened, associated, connected, or formed integrally together either by chemical or mechanical means, by processes including stamping, molding, or welding. What is more, two items can be coupled by the use of a third component such as a mechanical fastener, e.g., a screw, a nail, a bolt, a staple, or a rivet; an adhesive; or a solder.

As described herein, the term "coalescer" is a device containing glass fibers or other material to facilitate separation of immiscible liquids of similar density.

As used herein, the term "immiscible" means two or more phases that cannot be uniformly mixed or blended.

As used herein, the term "phase" means a liquid, a gas, or a suspension including a liquid and/or a gas, such as a foam, aerosol, or fog. A phase may include solid particles. Generally, a fluid can include one or more gas, liquid, and/or suspension phases.

DETAILED DESCRIPTION

Figure 1:
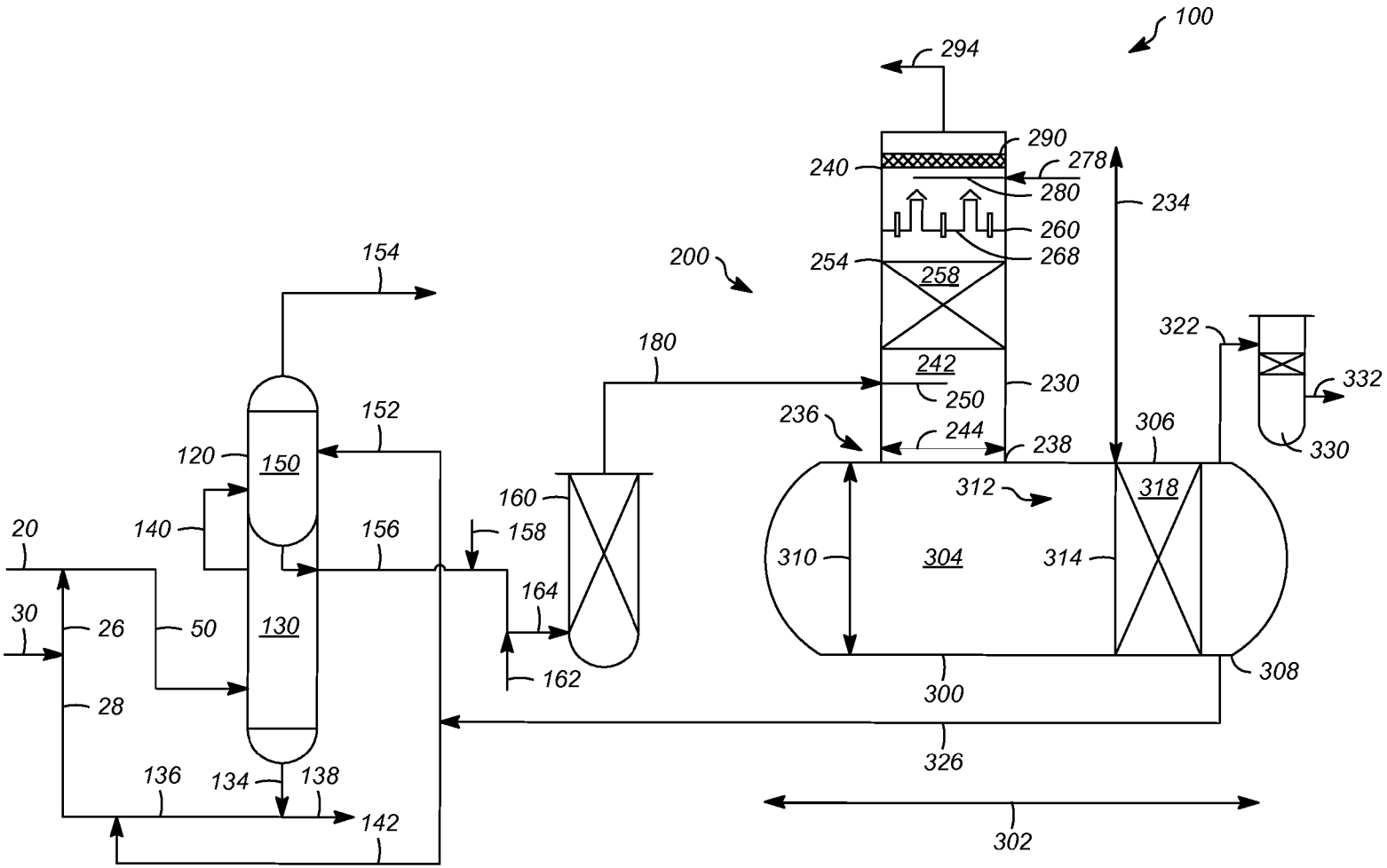
FIG. 1 is a schematic depiction of an exemplary apparatus.

Referring to FIG. 1, an exemplary apparatus 100 for removing one or more sulfur-containing compounds, such as mercaptans, from a hydrocarbon stream 20 is depicted in FIG. 1. Typically, the apparatus 100 can include an extractor vessel 120, an oxidation vessel 160, and a separation vessel 200. The vessels, lines and other equipment of the apparatus 100 can be made from any suitable material, such as carbon steel, stainless steel, or titanium. As depicted, process flow lines in the figures can be referred to as lines, pipes or streams. Particularly, a line or a pipe can contain one or more streams, and one or more streams can be contained by a line or a pipe.

The hydrocarbon stream 20 is typically in a liquid phase and can include a liquefied petroleum gas or a naphtha hydrocarbon. Typically, the hydrocarbon stream 20 contains sulfur compounds in the form of one or more mercaptans and/or hydrogen sulfide. Generally, the apparatus 100 can also include a caustic prewash vessel. Exemplary apparatuses having at least a caustic prewash vessel, an extractor vessel, an oxidation vessel, and a separation vessel for removing sulfur-containing compounds from a hydrocarbon stream are disclosed in, for example, U.S. Pat. No. 7,326,333.

A hydrocarbon stream 20 can be an effluent from, for example, a caustic prewash vessel. The hydrocarbon stream 20 can include hydrogen sulfide and C2-C8 hydrocarbons. Usually, the hydrocarbon stream 20 can include up to about 100 ppm, by weight, hydrogen sulfide. Generally, the hydrocarbon stream 20 is combined with a stream 26 including water from a stream 30 and a combined caustic stream 28, as hereinafter described, for removing, e.g., hydrogen sulfide. The caustic can be any alkaline material, and generally includes caustic soda (NaOH) and caustic alcohol ($C_2H_3ONa$). The streams 20 and 26 are combined as an extractor feed 50. The feed 50 can enter the extractor vessel 120. The extractor vessel 120 can include a lower pre-wash section 130, and an upper extractor section 150. The extractor feed 50 can enter the lower prewash section 130. A predominately hydrocarbon phase can rise while the caustic can fall in the prewash section 130. The caustic can be withdrawn via a caustic withdrawal 134 with a portion being spent caustic 138 and another portion being a caustic recycle 136. A transfer conduit 140 can transfer the hydrocarbon phase into the upper extractor section 150.

The hydrocarbon product 154 mostly free of mercaptans and mercaptides can be withdrawn from the top of the upper extractor section 150 while a spent caustic including mercaptides can be withdrawn via a line 156. The spent caustic 156 can be combined with an oxidation catalyst 158 and an air stream 162. The oxidation catalyst 158 can be any suitable oxidation catalyst, such as a sulfonated metal phthalocyanine. However, any suitable oxidation catalyst can be used such as those described in, for example, U.S. Pat. No. 7,326,333. The oxidation catalyst 158, the air stream 162, and the spent caustic 156 can be combined in a line 164 before entering the oxidation vessel 160. The spent aqueous caustic and air mixture is distributed in the oxidation vessel 160. In the oxidation vessel 160, the sodium mercaptans catalytically react with oxygen and water to yield caustic and organic disulfides. Optionally, the oxidation vessel 160 can include packing, such as carbon rings, to increase the surface area for improving contact between the spent caustic and catalyst. Afterwards, an effluent 180 from the oxidation vessel 160 can be withdrawn from the top of the vessel 160. The effluent 180 can include caustic, one or more hydrocarbons, one or more sulfur compounds, and a gas. Typically, the effluent 180 can include a gas phase, a liquid disulfide phase, and a liquid aqueous caustic phase. Generally, the gas phase includes air with at least some oxygen depletion. In the gas phase, the oxygen content can be about 5- about 21%, by mole.

The effluent 180 can be received in the separation vessel 200. The separation vessel 200 can be any suitable process equipment, such as a disulfide separator. The separation vessel 200 can include a stack 230 and a base 300. The separation vessel 200 can be operated at any suitable conditions, such as no more than about 60° C. and about 250- about 500 kPa, preferably about 350- about 450 kPa.

The stack 230 can be any suitable dimension for receiving the three-phase effluent 180. Typically, the stack 230 can have a height 234 and a width 244. Generally, the stack 230 is substantially cylindrical in shape having one or more walls 240 forming a void 242. Generally, the height 234 can be greater than the width 244.

In addition, the base 300 can have any suitable dimensions. Typically, the base 300 has a length 302 and a height 310 creating an interior space 304. Generally, the base 300 has a top 306 and a bottom 308. Usually, the length 302 is greater than the height 310. Typically, the stack 230 is coupled to the base 300 at any suitable angle. Preferably, the stack 230 is connected at an end 238 at a substantially perpendicular orientation 236 with respect to the length 302 of the base 300.

The stack 230 can contain a first distributor 250, a packed bed 254, a second distributor 260, a third distributor 280, and a demister 290. Generally, the first distributor 250 and the third distributor 280 can be any suitable distributor, such as respectively, a pipe with same or different sized slots for distributing the effluent 180 in the stack 230. The distributor 260 can be placed above the packed bed 254 and can be any suitable distributor, such as an elongated pipe with one or more slots, or a distributor as disclosed in, for example, U.S. Pat. No. 5,237,823 or 5,470,441. Generally, the liquid phases fall downward toward the base 300 and the gas phase rises upward in the stack 230. Usually, the packed bed 254 can include packing elements 258 that increase the surface area of the fluids interacting, as further described herein.

The packing elements 258 can be any suitable packing. One exemplary packing is ring packing, such as RASCHIG packing material sold by Raschig GmbH LLC of Ludwigshafen, Germany. Other types of packing can include structured packing, fiber and/or film contactors, or tray systems, e.g. one or more trays, as long as suitable contact is attained. Typically, the ring packing can be any suitable dimension, but is typically about 1 cm- about 5 cm in diameter. The packing elements 258 can be made from any suitable material, including carbon steel, stainless steel, or carbon.

Figure 2:
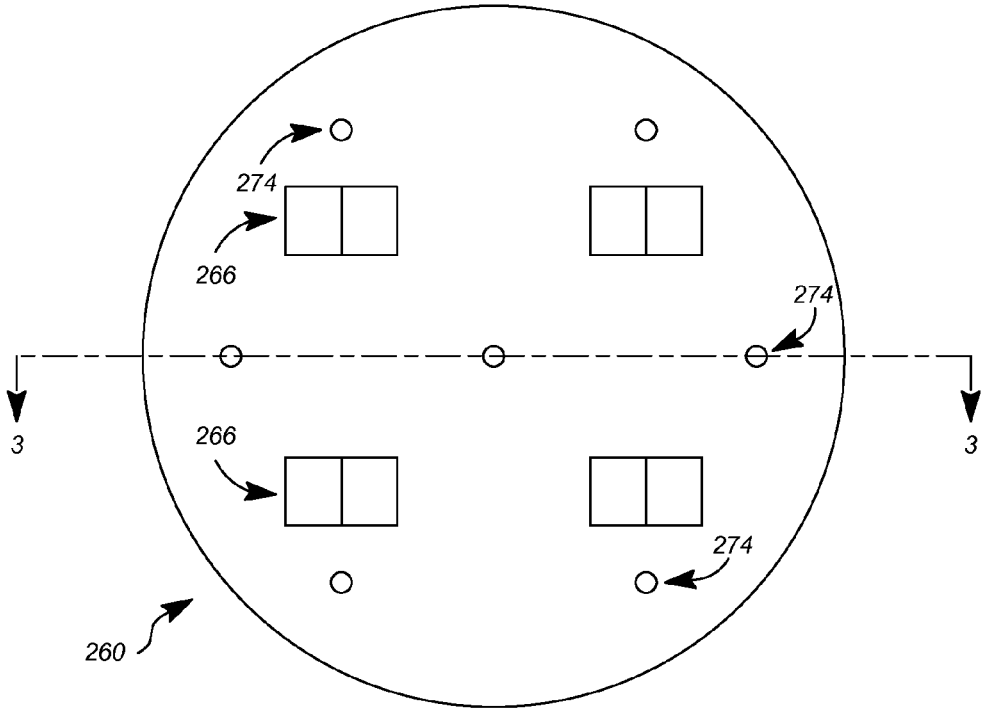
FIG. 2 is a top plan view of an exemplary distributor.
Figure 3:
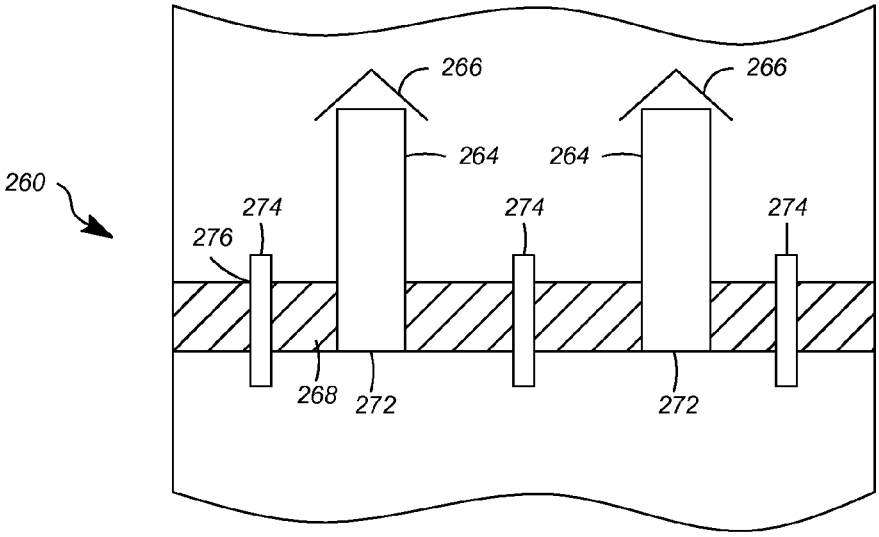
FIG. 3 is an elevational, cross-sectional view of the exemplary distributor along line 3-3 of FIG. 2.

Referring to FIGS. 1-3, the distributor 260 can include one or more risers 264, one or more drip guards 266 positioned above the risers 264, a substantially horizontal member 268, and one or more compartments 274. Typically, the substantially horizontal member 268 forms a plurality of apertures 272, which can have any suitable shape and be the same or different sizes. The one or more risers 264 can be positioned around at least some of the apertures 272 to allow gases to rise upward through the substantially horizontal member 268. The one or more compartments 274 generally have one or more holes in the side of the compartments to allow built-up fluid on the substantially horizontal member 268 to pass there-through to the packed bed 254 below. Typically, a base 276 of a compartment 274 can be coupled to the substantially horizontal member 268 with any suitable means, such as welding. In some exemplary embodiments, the periphery of one or more risers can at least partially define one or more compartments. Distributors 260 and 280 can also be combined to provide a single wash oil distributor.

The distributor 280 can be any suitable distributor providing a hydrocarbon stream 278 having a boiling point of about 50-about 300° C. Typically, the hydrocarbon stream 278 can be a wash oil that includes hydrotreated heavy naphtha or kerosene with little or no sulfur. The hydrocarbon stream 278 may also be a diesel oil. Generally, it is preferable that the hydrocarbon stream 278 has less than about 10 ppm, preferably less than about 1 ppm, by weight, of sulfur.

The demister 290 can be any suitable demister for removing liquid particles from a rising gas. Generally, the demister 290 can be a mesh or vane demister, preferably a mesh demister. During washing of the gas phase in the separation vessel 200, the third distributor 280 can provide the wash oil to the stack via a line 278. Optionally, the hydrocarbon stream 278, such as a wash oil, can be cooled to a temperature of about 38-about 43° C. to reduce or prevent corrosion in equipment and piping in gas service, e.g., the stack 230 and a line 294. The wash oil can then fall downward to the second distributor 260. The wash oil can collect on the substantially horizontal member 268 before passing through the one or more compartments 274 to the packed bed 254 below. The gas passing upward from the first distributor 250 can pass upward through the packed bed 254 with mass transfer occurring between the gas and the wash oil in the packed bed 254. The organic disulfide compounds can be stripped from the gas and collect in the wash oil which can drop from the stack 230 to the base 300 below. The gas can rise upward and pass through the one or more risers 264. The one or more drip guards 266 can prevent the wash oil from entering the one or more risers 264. Subsequently, the gas then passes through the demister 290 where any entrained liquid is removed. Afterwards, the gas can pass upwards through the stack and exit via the line 294. Generally, the total sulfur in the air exiting the stack 230 can be about 100 ppm, by weight. As such, the gas can be sent or optionally blended with fuel gas for use as a fuel in a heater or furnace.

The wash oil, liquid disulfide, and aqueous caustic phases can enter the base 300. The base 300 can include a coalescer 312. Generally, the coalescer 312 can include a support 314 and one or more coalescer elements 318, which can include at least one of a metal mesh, one or more glass fibers, sand, or an anthracite coal. The various liquid phases can pass through the coalescer 312 and be separated. Generally, the wash oil and the disulfide phase can exit via a line 322 to enter a filter 330, such as a sand filter. The filter 330 can remove any traces of caustic before passing an effluent 332.

Generally, the caustic can exit the bottom 308 of the base 300 through a line 326 and be split into separate branches 142 and 152. The regenerated caustic in the line 142 can be combined with caustic 136 to be combined with hydrocarbon stream 20. Another branch 152 can be provided to the upper extractor section 150 of the extractor vessel 120, as described above.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is

1. A process for removing one or more sulfur-containing hydrocarbons from a gas, comprising:

A) producing an effluent comprising a caustic, one or more hydrocarbons, one or more sulfur compounds, and a gas from an oxidation vessel;

B) sending the effluent to a stack of a disulfide separator, wherein the stack comprises:

1) one or more walls surrounding a void and adapted to receive a fluid comprising one or more phases;

2) a packed bed positioned within the void; and 3) a distributor comprising one or more risers and one or more compartments coupled to a substantially horizontal member forming a plurality of apertures therethrough; and C) introducing a hydrocarbon stream having a boiling point of about 50° to about 300° C into the stack that passes downward through the packed bed to remove one or more sulfur compounds from the air, wherein the disulfide separator is at a temperature and a pressure effective to remove the one or more sulfur compounds.

2. The process according to claim 1, wherein the gas comprises air.

3. The process according to claim 1, wherein the hydrocarbon stream is cooled to about 38° to about 43° C. before entering the stack to reduce corrosion.

4. The process according to claim 1, wherein the disulfide separator is at a temperature of no more than about 60° C. and a pressure of about 250 to about 500 kPa.

5. The process according to claim 1, wherein the packed bed comprises one or more packing elements, in turn, comprising at least one of a ring packing, a fiber contactor, a film contactor, and one or more trays.

6. The process according to claim 1, wherein the disulfide separator further comprises:

a base, wherein the base defines an interior space; and a coalescer positioned within the interior space.

7. The process according to claim 6, further comprising:

passing an effluent comprising one or more disulfide hydrocarbons from a top of the base; and passing another effluent comprising the caustic from a bottom of the base.

8. A process for removing one or more sulfur-containing hydrocarbons from a gas, comprising:

A) producing an effluent comprising a caustic, one or more hydrocarbons, one or more sulfur compounds, and a gas from an oxidation vessel;

B) sending the effluent to a stack of a disulfide separator, wherein the stack comprises:

1) one or more walls surrounding a void and adapted to receive a fluid comprising one or more phases;

2) a packed bed positioned within the void; and 3) a distributor comprising one or more risers and one or more compartments coupled to a substantially horizontal member forming a plurality of apertures therethrough;

C) cooling a hydrocarbon stream to about 38° to about 43° C. before entering the stack to reduce corrosion; and D) introducing the hydrocarbon stream having a boiling point of about 50° to about 300° C. into the stack that passes downward through the packed bed to remove one or more sulfur compounds from the air, wherein the disulfide separator is at a temperature and a pressure effective to remove the one or more sulfur compounds.

9. The process according to claim 8, wherein the gas comprises air.

10. The process according to claim 8, wherein the disulfide separator is at a temperature of no more than about 60° C. and a pressure of about 250 to about 500 kPa.

11. The process according to claim 8, wherein the packed bed comprises one or more packing elements, in turn, comprising at least one of a ring packing, a fiber contactor, a film contactor, and one or more trays.

12. The process according to claim 8, wherein the disulfide separator further comprises:

a base, wherein the base defines an interior space; and a coalescer positioned within the interior space.

13. The process according to claim 12, further comprising:

passing an effluent comprising one or more disulfide hydrocarbons from a top of the base; and passing another effluent comprising the caustic from a bottom of the base.

14. A process for removing one or more sulfur-containing hydrocarbons from a gas, comprising:

A) producing an effluent comprising a caustic, one or more hydrocarbons, one or more sulfur compounds, and a gas from an oxidation vessel;

B) sending the effluent to a stack of a disulfide separator wherein the disulfide separator is at a temperature of no more than about 60° C. and a pressure of about 250 to about 500 kPa and wherein the stack comprises:

1) one or more walls surrounding a void and adapted to receive a fluid comprising one or more phases;

2) a packed bed positioned within the void; and 3) a distributor comprising one or more risers and one or more compartments coupled to a substantially horizontal member forming a plurality of apertures therethrough; and C) introducing a hydrocarbon stream having a boiling point of about 50° to about 300° C. into the stack that passes downward through the packed bed to remove one or more sulfur compounds from the air, wherein the disulfide separator is at a temperature and a pressure effective to remove the one or more sulfur compounds.

15. The process according to claim 14, wherein the gas comprises air.

16. The process according to claim 14, wherein the hydrocarbon stream is cooled to about 38° to about 43° C. before entering the stack to reduce corrosion.

17. The process according to claim 14, wherein the packed bed comprises one or more packing elements, in turn, comprising at least one of a ring packing, a fiber contactor, a film contactor, and one or more trays.

18. The process according to claim 14, wherein the disulfide separator further comprises:

a base, wherein the base defines an interior space; and a coalescer positioned within the interior space.

19. The process according to claim 18, further comprising:

passing an effluent comprising one or more disulfide hydrocarbons from a top of the base; and passing another effluent comprising the caustic from a bottom of the base.

* * * * *